US005241800A

United States Patent [19]

Steinke et al.

[11] Patent Number: 5,241,800

[45] Date of Patent: Sep. 7, 1993

[54] CHUB MACHINE

[75] Inventors: Gary L. Steinke, Bettendorf; Russell S. Johnson, Jr.; Rick A. Meeker, both of Davenport, all of Iowa

[73] Assignee: The Kartridg Pak Co., Davenport, Iowa

[21] Appl. No.: 956,665

[22] Filed: Oct. 2, 1992

[51] Int. Cl.[5] ..... B65B 3/04; B65B 9/08

[52] U.S. Cl. ..... 53/55; 53/503; 53/551

[58] Field of Search ..... 53/55, 503, 77, 138.4, 53/138.3, 138.2, 552, 551, 550, 451

[56] References Cited

U.S. PATENT DOCUMENTS

| | | | |
|---|---|---|---|
| 2,831,302 | 4/1958 | Jensen et al. | 53/138.4 |
| 3,324,621 | 6/1967 | Runge | 53/138.4 |
| 3,380,226 | 4/1968 | Tracy | 53/138.4 |
| 3,611,657 | 10/1971 | Inoue et al. | 53/138.4 X |
| 3,795,083 | 3/1974 | Wells | 53/138.4 |
| 4,085,778 | 4/1978 | Wright | 53/138.4 X |
| 4,939,885 | 7/1990 | Steinke | 53/138.4 |
| 4,976,091 | 12/1990 | Salemke et al. | 53/503 X |

*Primary Examiner*—James F. Coan

*Attorney, Agent, or Firm*—Lockwood, Alex, FitzGibbon & Cummings

[57] ABSTRACT

An automatically controlled Chub packaging machine wherein the product delivery pump, tube or film feed, and clamping mechanism of the vertically reciprocating clipping head, are automatically controlled by means of servo actuators operatively connected to a microprocessor. The microprocessor of the automatic control system also coordinates the functioning of the film heat sealer and the voider. An operator interface membrane panel with video display allows the operator to set, observe and adjust the various functions of the machine. The microprocessor system links all elements together and places various rates and set points in memory for immediate recall.

5 Claims, 4 Drawing Sheets

CHUB MACHINE

BACKGROUND AND DESCRIPTION OF THE INVENTION

This invention relates, generally, to innovations and improvements in package-forming machines known in the packaging art as Chub machines which form tubular packages which are gathered and clipped at opposite ends.

An early form of the Chub machine is disclosed in U.S. Pat. No. 2,831,302 issued Apr. 22, 1958. Improvements and innovations on the original Chub machine have been made over the years, a number of which have formed the subject matter of additional U.S. patents, including: U.S. Pat. Nos. 3,324,621 dated Jun. 13, 1967; 3,795,083 dated Mar. 5, 1974; 3,380,226 dated Apr. 30, 1968; 4,085,778 dated Apr. 25, 1978; 4,223,508 dated Sep. 23, 1980 and 4,939,885 dated July 10, 1990. These additional patents have been assigned to the assignee of the present invention. In addition to disclosures in the foregoing patents, Chub package forming machines are in wide use in this country and described in printed service manuals, and have been commercially available from The Kartridg Pak Co. of Davenport, Iowa for a number of years. Chub machines can be used for packaging many flowable or extrudable materials. For example, various edible products such as ground meat, cheese, liver sausage, butter, ice cream and cookie dough have been packaged utilizing the Chub machines. Inedible products have also been packaged utilizing the Chub machines including explosives.

In operation, a Chub machine continuously unwinds and forms a tube from a roll of film, fills the tube with a flowable material, gathers or constricts at regular intervals short lengths of the filled tubing, applies a pair of closure clips to each gathered length of tubing, and severs the gathered or constricted material between the individual clips in a pair thereof.

In operation, the Chub machines also unwind two strands of wire from coils or reels and cut off predetermined lengths from the ends of the wire so as to provide the clips which are then suitably formed and constricted in pairs to each gathered length of tubing.

The primary operating components or elements of a Chub machine are: the tube-forming mechanism whereby a web of film is withdrawn from a supply roll, folded over around a hollow mandrel into a tube and heat or otherwise sealed; a product metering pump which injects flowable product through the mandrel out into the tube; a tube or film feed mechanism which continuously feeds the tube over and away-from the mandrel; a voider which flattens or collapses short lengths of the filled tube at predetermined intervals; and a clipping head which applies a pair of spaced clips to the voided and gathered tube and severs the tube intermediate the clips. Heretofore, these operating components or sub-assemblies have been manually pre-set by the operator so that their combined operation is properly coordinated. Settings will vary depending on various factors including type of product, seal-forming characteristics of the film and package size. During a particular run it may become necessary to make adjustments in the various settings. Some adjustments can be made during a run while others require either slowing or shutting down the Chub machine. When a Chub machine has been running on one product it is usually necessary to reset the machine during down-time in order for it to package a different product.

It will be apparent that pre-setting, adjusting and re-setting a Chub machine are time-consuming and require skill on the part of the operator. Heretofore, Chub machines offered independent controls of operating components without linkage. If one component or element of a machine was changed, all the remaining components (motors, timers, etc.) normally had to be changed manually with trial and error techniques requiring considerable operator skill. The present invention links the elements together and places the various rates and set points in memory for immediate recall as needed.

In accordance with the present invention, Chub machines have been provided with automatic control and monitoring systems which by means of microprocessors or computers are operatively interconnected with servo actuators which are in turn operatively connected with the various machine operating components, allow the machines to be automatically pre-set, fine-tune adjusted and re-set using data stored in the memory systems of the microprocessors.

Accordingly, the object of the invention, generally stated is the provision of the Chub packaging machines which are automatically controlled and monitored so as to minimize manual setting or adjustment of the various operating components either on start-up of a run, during the course of a run, or on change-over for packaging a different product.

An important object of the invention is the provision of Chub machines with automatic controls and monitoring systems which are readily set and adjusted, which have stored data memory capabilities and which include an operator interface membrane panel with video display which allows the operator to monitor, set, observe and adjust the various functions of the machine either while idle or running.

Certain other and certain more specific objects of the invention will be apparent to those skilled in the art in the light of the following detailed description taken in conjunction with the accompanying drawings, wherein.

Figure 1:
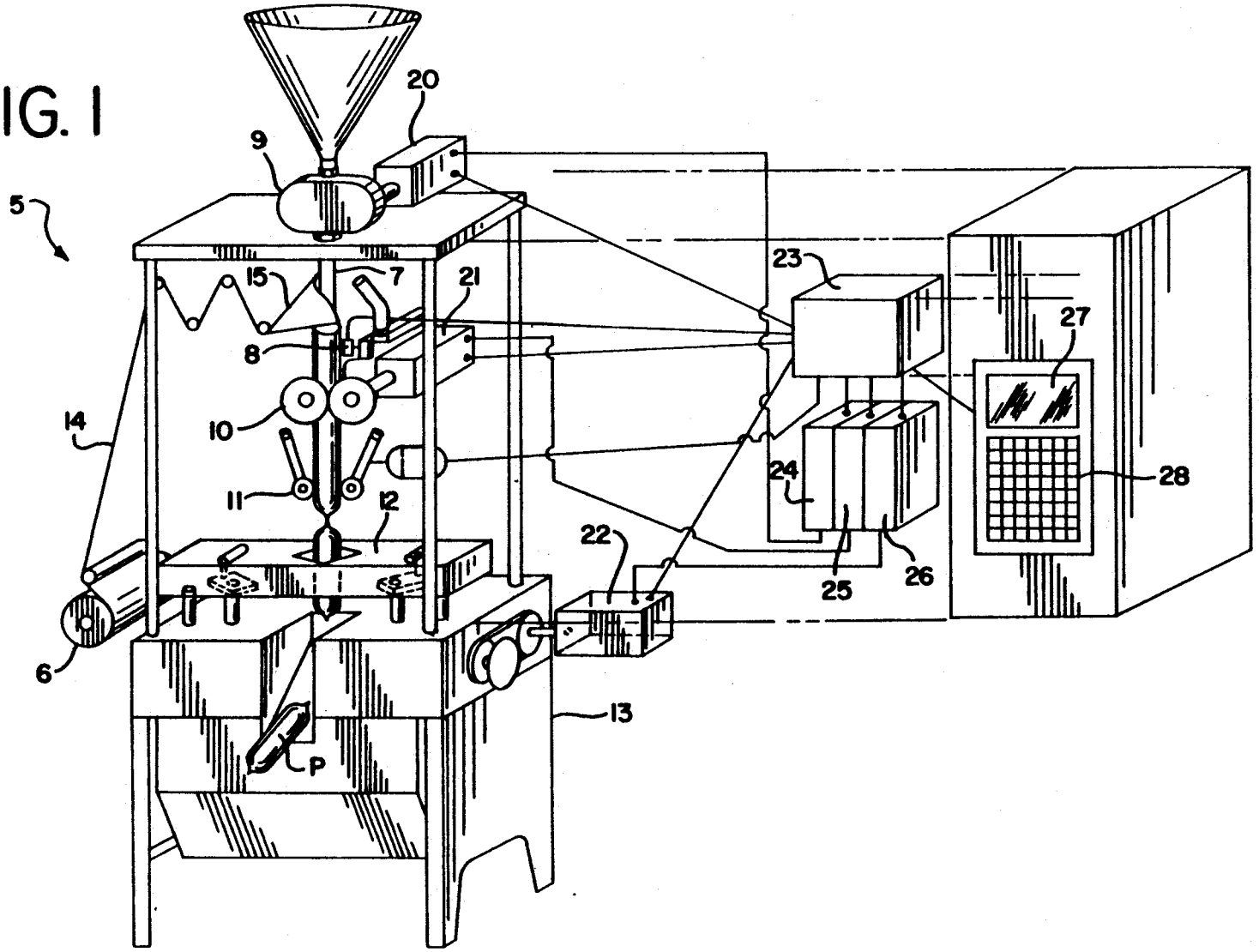
FIG. 1 is a diagrammatic view of a Chub machine incorporating an automatic control system in accordance with the present invention.

Referring to FIG. 1, a Chub machine as indicated generally at 5 which incorporates the basic structure, operating components and sub-assemblies common to known Chub machines, including the Chub machines described in the above-mentioned patents. The machine 5 will be recognized by those familiar with Chub machines as having a film arbor 6, a mandrel 7, a tube seam overlap heat sealer 8, a product delivery pump 9, a film drive 10, a voider 11, a clipping head assembly 12, a wire feed/cut-off assembly (not shown) carried by the clipping head, and a drive mechanism (not shown) housed in the base 13 of the machine.

As is well known to those familiar with Chub machines, conventionally, a web 14 of packaging film is continuously withdrawn from the arbor 6 when the machine 5 is in operation. The web 14 is led to a film folder 15 where the film is folded and its side edges overlapped thereby forming the web into a tube surrounding the mandrel 7. The sealer 8 acts to heat seal or otherwise bond the overlapped edges thereby completing the formation of a continuous tube. The film drive 10 engages the exterior of the tube and serves to continuously feed the tube downwardly. Below the film drive mechanism 10 the tube receives a metered quantity of flowable product through the mandrel 7. On passing through the voider 11 the voider rolls, at predetermined intervals, depending on the length of the packages being formed, momentarily swing inwardly together compressing the product-filled tube and thereby substantially voiding or expelling product from a short length of tube which has been flattened between the voider rolls. Each voided length of the tube is gathered in the clipping head 12 and a pair of vertically spaced clips applied to the gathered tube. The lower clip completes the formation of the upper end of one Chub package while the upper clip forms the lower end of the next package. Immediately following the application of the clips a reciprocating knife severs the tube midway between the clips thereby allowing the completed Chub package P to exit the machine.

As is well known to the operators of Chub machines the functioning of the product delivery pump 9, sealer 8, film feed 10, voider 11 and clipping head 12 must be coordinated. Accordingly, before a production run is to be made on changing over to running a package different from that previously run on the machine 5, appropriate settings of the operating components must be made. Further, once a new run has started the operator will usually need to make adjustments to, in effect, fine-tune the machine. And during a run the operator will monitor the operation of the machine and make minor adjustments from time to time as needed.

The present invention provides an automatic control and monitoring system for Chub machines such as the machine 5 which facilitates both the initial and change-over setting of the operating components as well as adjustments thereof required during the course of a run. Less skill is required on the part of the operator, set-up and change-over times are shortened, fewer down-times are encountered, package uniformity is enhanced and fewer defective packages are produced when a Chub machine is equipped with the automatic control and monitoring system of the present invention.

Referring to FIG. 1, the automatic control and monitoring system comprises: a pump drive servo 20 operatively connected to the product delivery pump 9; a film drive servo 21 is operatively connected to the film drive 10; and a clamp drive servo 22 is operatively connected to the clipping head 12. The servos 20, 21 and 22 may be of known commercial type such as:

Pump drive servo 20:

a. #B402-A-29-5-035 Servo Motor—Industrial Drives
b. #MZ94760L1 right angle reducer—Dodge
c. Poly chain 1:1 bolt drive from reducer to pump—Gates Film drive servo 21:

a. #MT56H1033 DC 1 HP perm. magnet motor—Reliance
b. #96-082T-000 digital tach—Dynapar
c. #6VFWC21JR SCR motor controller—G.E.

Clamp drive servo 22:

a. #B402-C-31 Servo Motor—Industrial Drives
b. Poly chain belt drive to hand wheel shaft—Gates The actuator for the voider 11 may comprise:

a. 4-way solenoid valve—MAC
b. 2½" bore×2" stroke JIC air cylinder with rear clevis mount—C&C A machine controller 23 in the form of a microprocessor or computer of known commercial type is a key component of the control and monitoring system. One such microprocessor that has served satisfactorily includes the following:

a. #ZT32C-12WP2OF standard bus card cage & power supply—Ziatech
b. #ZT8901 V53 computer—Ziatech
c. #ZT8842 VGA video controller—Ziatech
d. #4323-2 servo motor controller—Tech 80
e. #7509 analog interface board—Pamux
f. #ZT89CT61 digital interface board—Ziatech Inputs to the controller 23 are connected in signal receiving relationship to the servos 20, 21 and 22 and also to the heat sealer 8 and voider 11 as indicated. Three outputs of the controller 23 are connected to three servo motor controls 24, 25 and 26 of known commercial type which are in turn connected in signal delivering relationship to the servos 20, 21 and 22, respectfully as diagrammatically indicated. The servo motor controls 24, 25 and 26 may comprise the following:

a. #PSR4/5—212 power supply—Industrial Drives
b. #BDS4-210J-0001/402C2p servo amplifier (clamp drive)—Industrial Drives
c. #BDS4-203J-0001/402A2 amplifier—Industrial Drives Another output of the microprocessor controller 23 is operatively connected to a #996-0107-00 electroluminescent display-Planar 27 which is housed in a custom designed operator interface membrane panel 28. The monitor 27 serves as a computer display which enables the operator to effectively manage high levels of production from the Chub machine 5 using easy to read symbolic keys on the membrane panel, multiple language screen displays and memory storage registers for various product operating presets. There may also be included a full range of screen displayed alarms and diagnostics to ensure minimum down time.

In practice, a Model 39 Chub machine of The Kartridg Pak Company of Davenport, Iowa equipped with one of its high speed M 7 clipping heads was reconfigured to incorporate an automatic control and monitor system in accordance with the invention as described in connection with FIG. 1. The new machine is indicated generally at 30 in FIG. 2 and includes a microprocessor or computer which calculates and controls all machine functions including:

1. Motors driving pump, film feed and clipping head.
2. Air cylinders operating all machine accessories.
3. Temperature control of all accessories.
4. Various encoders and sensors for tension control and all closed loop control.

Figure 2:
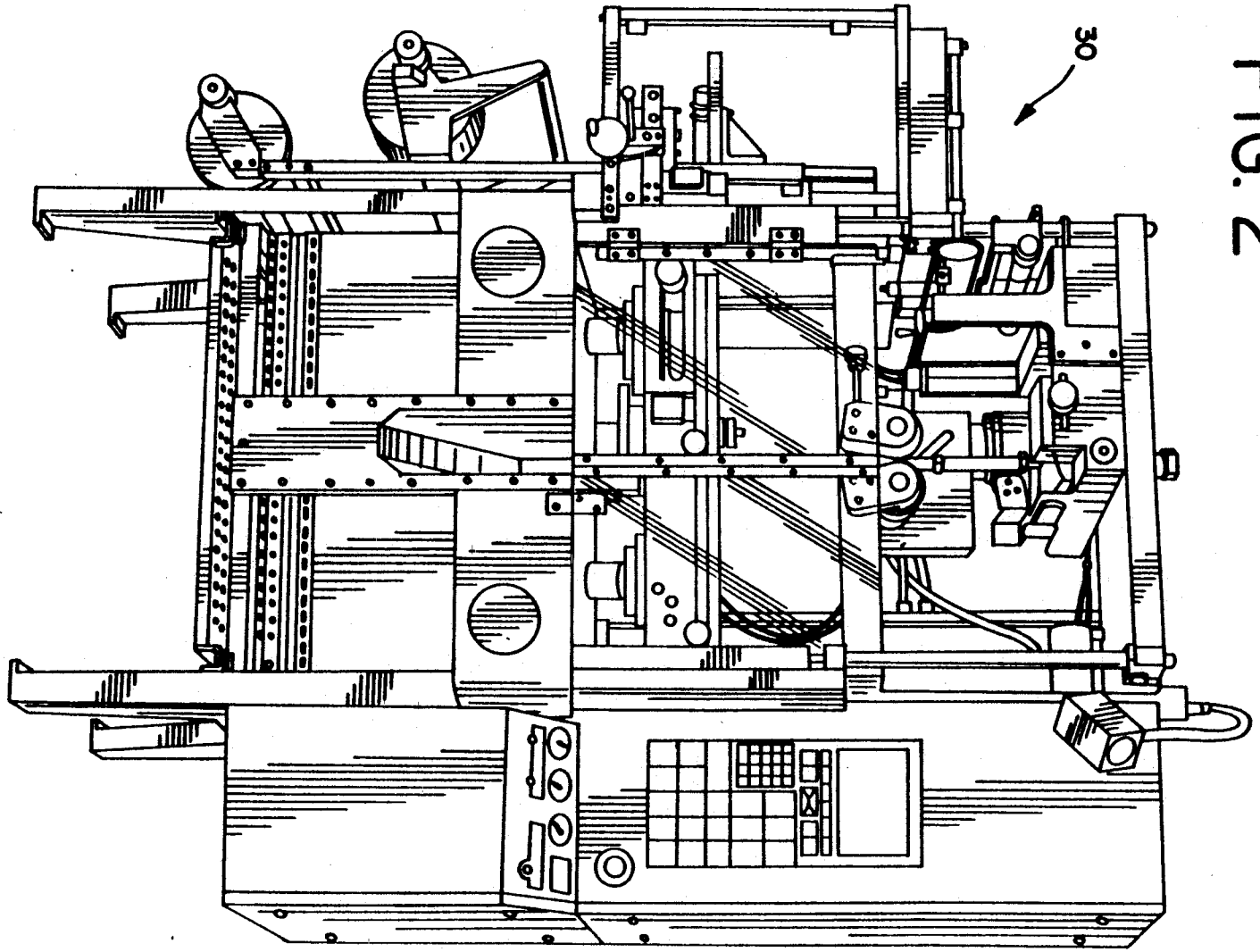
FIG. 2 is a perspective view of a commercial Chub machine incorporating the automatic control and monitoring system and essential features of the invention as set forth in connection with FIG. 1.
Figure 3:
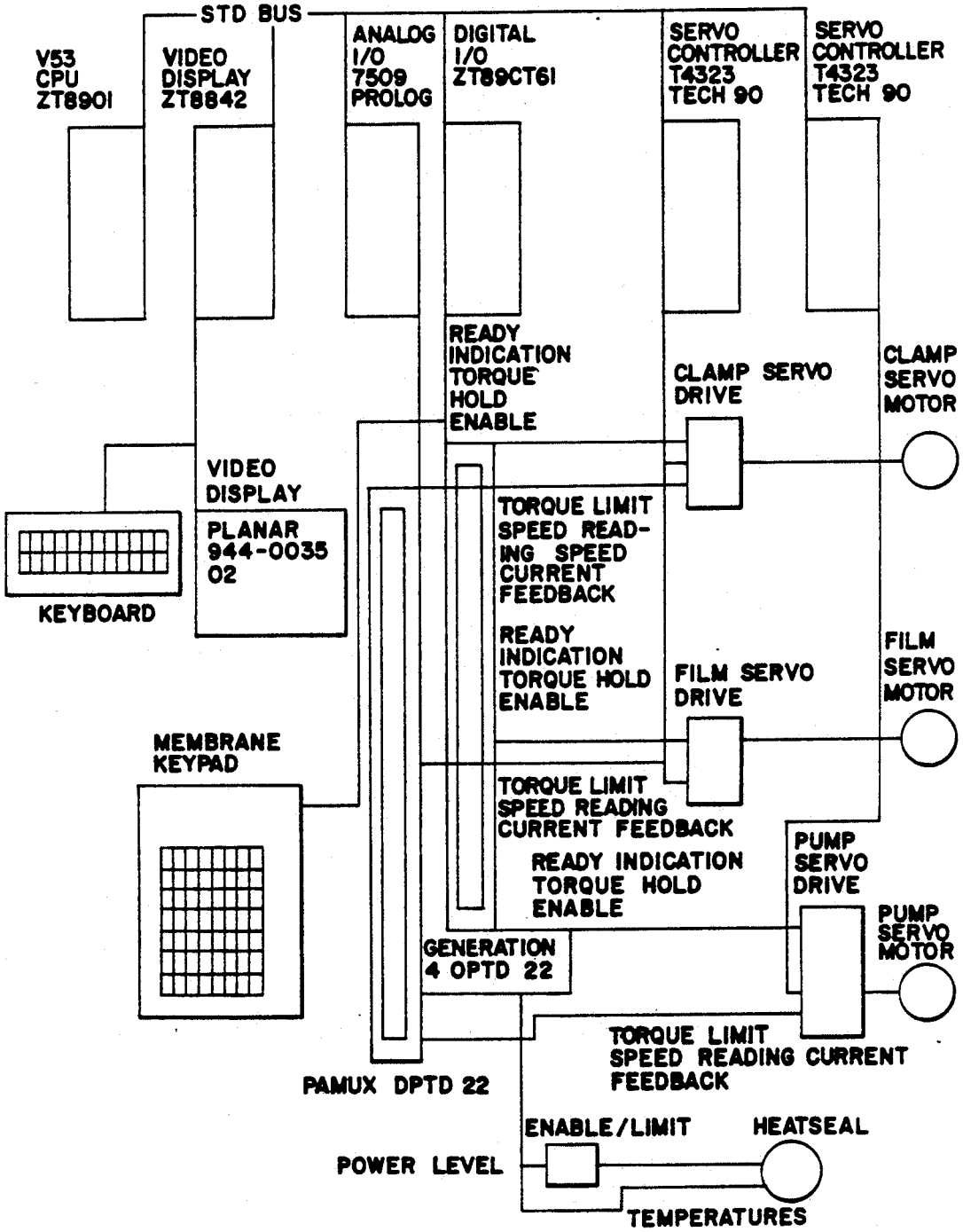
FIG. 3 is the electrical system layout for the Chub machine shown in FIG. 2.

FIG. 3 is the electrical system layout for the new machine shown in FIG. 2.

Figure 4:
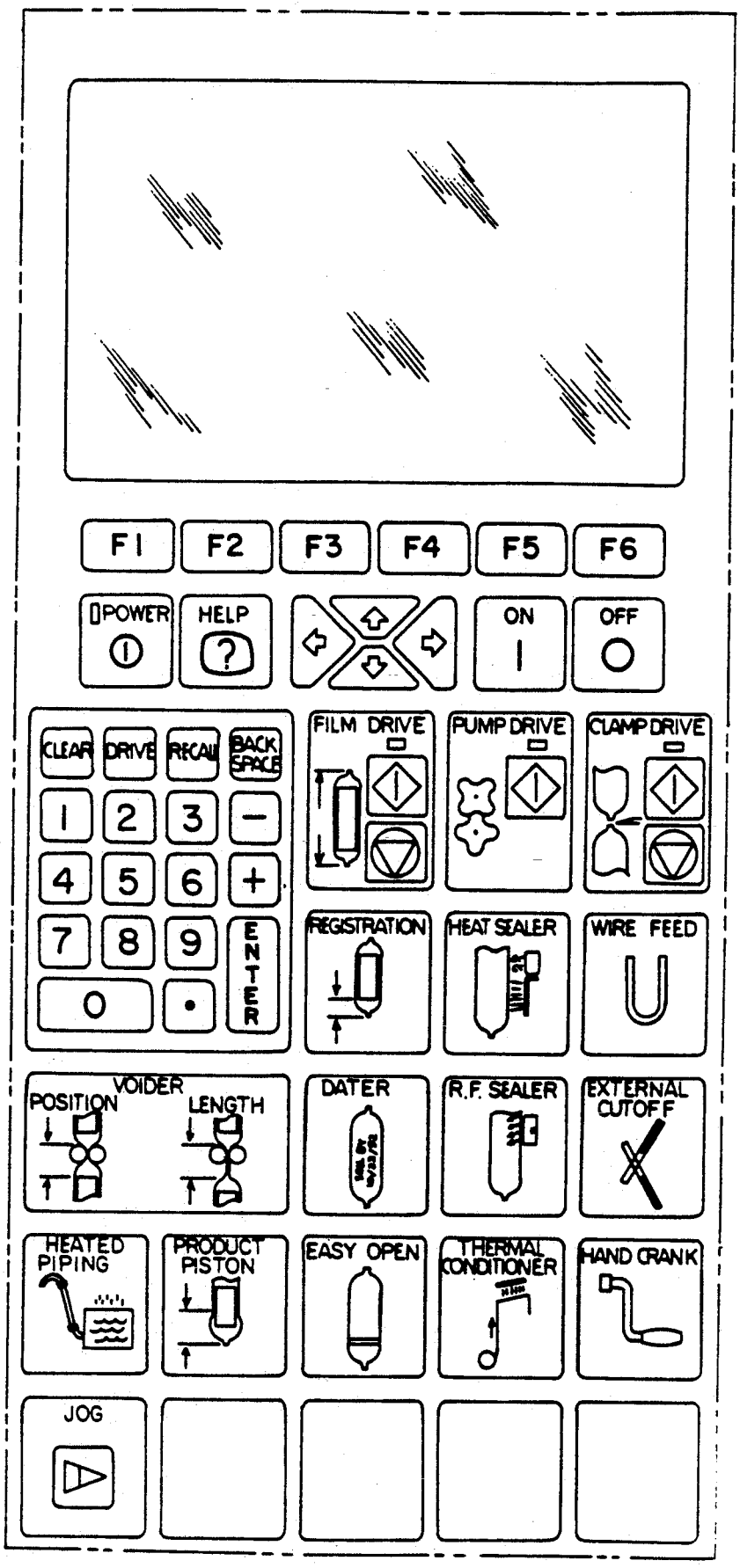
FIG. 4 is an enlargement of the operator interface of the machine shown in FIG. 2.

Referring to the operator interface as shown in FIG. 4, the function pads F1–F6 enable the operator to access program functions. Various functions are displayed along the bottom of the display monitor. The cursor pad consists of four individual directional pads, i.e., left arrow, right arrow, up arrow and down arrow. The number pad has the digits 1–9 and also 0 together with other pads including "clear", "save", "recall" and "back space" along with an "enter" pad and "plus" and "minus" pads.

The film drive pad contains three icons, namely, a Chub Package length, Start and Stop. The pump drive pad consists of two icons, namely, pump rate and start. The clamp drive pad consists of three icons, namely, Chub Packages per minute, Start and Stop. The heat sealer pad enables the operator to turn the heat sealer "on" or "off". The wire feed pad allows the operator to turn the wire feed "on" or "off". The voider pad consists of two icons, namely, one for position and the other for length. Certain other pads are included as indicated.

What is claimed:

1. In a machine for forming chub packages and having: means for forming a web of packaging material into a tube; means for continuously feeding said tube downwardly over a hollow mandrel; pump means for delivering a flowable product to said mandrel so as to discharge product from the lower end of said mandrel into said tube; and a vertically reciprocating clipping head assembly through which said tube containing product passes and wherein during said passage short lengths of said tube are gathered and clamped between opposing sets of gathering plates carried on horizontally reciprocating support cams, pairs of spaced clips are applied to each said short length and each said short length is severed by a reciprocating cut-off knife between each said pair of applied clips; an automatic system for controlling the operation of said machine, comprising: a pump drive servo operatively connected to said pump means, a film drive servo operatively connected to said tube feeding means, and a clamp drive servo operatively connected to said closure head assembly;

a machine controller microprocessor connected in signal input relationship with said pump drive servo, said film drive servo and said clamp drive servo;

a pump drive servo motor control operatively interconnected between said microprocessor and said pump drive servo so as to receive an output signal from said microprocessor and deliver a control signal to said pump drive servo, a film drive servo motor control operatively interconnected between said microprocessor and said film drive servo so as to receive an output signal from said microprocessor and deliver a control signal to said film drive servo, and a clamp drive servo motor control operatively interconnected between said microprocessor and said clamp drive servo so as to receive an output signal from said microprocessor and deliver a control signal to said clamp drive servo.

2. In the machine called for in claim 1, voider means for periodically voiding product from a short length of said tube prior to reaching said closure head assembly, operatively connected in signal output receiving relationship with said microprocessor.

3. In the machine called for in claim 1, a film sealer forming part of said tube forming means operatively connected in signal input relationship with said microprocessor.

4. In the machine called for in claim 1, a film sealer forming part of said tube forminq means operatively connected in signal input relationship with said microprocessor and voider means for periodically voiding product from a short length of said tube prior to reaching said closure head assembly, operatively connected in signal output receiving relationship with said microprocessor.

5. In the machine called for in claim 1, a video display monitor operatively connected with said microprocessor whereon machine operating conditions are displayed.

* * * * *